United States Patent [19]

Johnson

[11] Patent Number: 5,056,835

[45] Date of Patent: Oct. 15, 1991

[54] LATCHING MECHANISM FOR A CLOSURE WITH A DISCONNECTABLE HANDLE AND A SLIDING CATCH

[75] Inventor: Raymond A. Johnson, Hot Springs, Ark.

[73] Assignee: The Chamberlain Group, Inc., Elmhurst, Ill.

[21] Appl. No.: 588,369

[22] Filed: Sep. 26, 1990

[51] Int. Cl.[5] ..... E05C 3/04

[52] U.S. Cl. ..... 292/207; 292/224; 292/DIG. 27

[58] Field of Search ..... 292/DIG. 27, 207, 208, 292/106, 224, 150

[56] References Cited

U.S. PATENT DOCUMENTS

| | | | |
|---|---|---|---|
| 804,399 | 11/1905 | Hardenbergh | 292/DIG. 27 |
| 855,177 | 5/1907 | Jack | 292/DIG. 27 |
| 1,057,898 | 4/1913 | Thompson . | |
| 1,090,772 | 3/1914 | WIlson . | |
| 1,143,610 | 1/1915 | Carr | 292/DIG. 27 |
| 1,968,285 | 7/1934 | Egan | 292/DIG. 27 |
| 2,700,566 | 1/1955 | Wartian | 292/221 |
| 2,707,121 | 4/1955 | Behnke | 292/228 |
| 2,733,089 | 1/1956 | Greevengoed | 292/1 |
| 2,797,949 | 7/1957 | Schweitzer | 292/224 |
| 2,801,869 | 8/1957 | George | 292/226 |
| 2,851,871 | 9/1958 | Newell | 70/150 |
| 2,920,472 | 1/1960 | Welch | 292/224 |
| 2,942,906 | 6/1960 | Gilpatrick | 292/224 |
| 3,159,994 | 12/1964 | Schulz | 292/207 |
| 3,797,869 | 3/1974 | Shaw | 292/207 |
| 4,099,756 | 7/1978 | Kagoura | 292/336.3 |
| 4,108,482 | 8/1978 | Dietrich et al. | 292/DIG. 27 |
| 4,389,062 | 6/1983 | Rosenberg | 292/190 |
| 4,732,418 | 3/1988 | Crown et al. | 292/207 |

*Primary Examiner*—Eric K. Nicholson

[57] ABSTRACT

A latching mechanism for mounting on a closure, such as a storm door. The mechanism includes an inside housing with a latch movably mounted on the inside housing and including a tongue movable between a latching position for engaging the striker plate defining the doorway, and an unlatching position in which the tongue permits opening of the door. An operating shaft extends through the closure and the inside housing and is pivotally mounted with respect to them. Inside and outside operators are mounted on the shaft. A cam is rotatable with the shaft and is axially slidable with respect to the shaft between an operative position in which the cam is located to move the tongue toward its unlatching position, and an inoperative position in which rotation of the cam does not cause movement of the tongue. The latching mechanism further includes a slide lock for movement by the operator between a locking position in which the slide causes the cam to be placed in its inoperative position and an unlocking position in which the cam is permitted to be in its operative position. The slide includes an abutment which, when the slide is in its locking position, is in alignment with the tongue to positively prevent the tongue from moving to its unlatching position, thereby providing a dead bolt function.

16 Claims, 5 Drawing Sheets

LATCHING MECHANISM FOR A CLOSURE WITH A DISCONNECTABLE HANDLE AND A SLIDING CATCH

The subject invention relates to closures and, more particularly, to a latching mechanism for a door, especially a storm door.

BACKGROUND OF THE INVENTION

Typically in light duty latching mechanisms, such as employed in storm doors, rotation of the door handle positively moves the latch tongue to its unlatching position permitting opening of the door. Locking is accomplished by movement of a bar or other component to prevent rotation of the handle. Faced with an immobile handle, a potential intruder may apply sufficient force to the handle to result in breakage of a component of the latching mechanism. If latching is achieved by disconnecting the inside and outside handles from the latch, the potential intruder may well be discouraged by the knowledge that in spite of the force applied to the handle, the locking component will not be overcome.

The usual storm door latching mechanism does not provide a "dead bolt function". As used herein "dead bolt function" is to be accorded its broad meaning that a locking component, which could be the latch, is positively prevented from being moved to a non-interfering position, and is not to be construed so narrowly as to require a bolt separate from the latch. In the typical storm door latching mechanism, the latch is spring biased to its latching position. Thus through the use of a tool or a stiff plastic card inserted against the latch between the door and the doorway frame, the biasing force could be overcome and the latch deflected or pushed to its non-interfering position.

A prior art storm door latching mechanism includes a handle which is disconnected from the latch when the mechanism is in its latching condition. This mechanism also includes a separate dead bolt which is thrown by the use of a driver discrete from the components associated with the latch. This mechanism is relatively expensive and employs many parts. Furthermore the user is required to take a further step to throw the dead bolt over and above the step required to lock the latch.

U.S. Pat. No. 1,057,898 to Thomoson shows a lock assembly in which rotation of a small knob causes cam surfaces to shift the bolt out of alignment with arms which are rotated upon turning of a large knob thereby locking the bolt. The lock can be unlocked using a key which is received in a key slot. When the key is rotated, the lug held on the shaft including the key slot, engages a curved bar of the bolt to cause retraction of the bolt.

U.S. Pat. No. 2,733,089 to Grevenooed illustrates a latch mechanism for screen doors including a spindle having a generally square cross section. The mechanism also includes a locking bar which is horizontally slidable and includes an aperture having an enlarged end. When the locking bar is positioned so that the enlarged end receives the spindle, the handles can be rotated; however, when the locking bar is moved so that the spindle is received in the smaller end of the opening, the bar prevents the handles from moving thereby locking the mechanism.

U.S. Pat. No. 4,099,756 to Kaooura shows first and second bolt driving units. The second unit includes a knob which when pushed causes a pin to force the end of a first driver torque bar out of the hollow shaft used to actuate the latch bolt.

U.S. Pat. No. 2,707,121 to Behnke is directed to a screen door latch including a latching slide with a dog for reception in a recess of the spindle to prevent rotation.

SUMMARY OF THE INVENTION

Among the several aspects and features of the present invention may be noted the provision of an improved latching mechanism for storm doors. The latching mechanism operates to disconnect the handles from the latch, which is biased to its latching position, when a locking mechanism is actuated. Thus the application of force to the handles will not affect the positioning of the latch. Additionally when the locking mechanism is actuated, the latch is positively prevented from being moved to its unlatching position whereby the latch additionally provides a dead bolt function. The latching mechanism is easily mounted on the door, includes relatively few parts, and provides visual indication of its locking condition. Furthermore, the latching mechanism is reliable in use, has long service life, and is relatively easy and economical to manufacture. Additional aspects and features of this invention will be, in part, apparent and, in part, will be pointed out specifically in the following specification and accompanying drawings.

Briefly, the latching mechanism of the present invention includes an inside housing for mounting on the inside of the storm door, and a latch which is pivotally mounted on the inside housing. The latch includes a tongue movable between a latching position to interfere with the striker plate of the door frame, and an unlatching position in which the tongue permits the storm door to be opened. An operating shaft extends through the door and the inside housing and the shaft is pivotally mounted with respect to them. Inside and outside handles are mounted on the shaft. A cam plate is rotatable with the shaft and is also axially slidable with respect to the shaft between an operative position in which the cam plate is located to move the tongue toward the unlatching position upon pivoting of the handles, and an inoperative position in which rotation of the cam plate does not effect movement of the tongue. The latching mechanism further includes a slide lock for movement by a user between a locking position in which the cam plate is caused to be moved to its inoperative position, and an unlocking position in which the cam plate is permitted to be in its operative position. The slide lock includes an abutment for positioning in alignment with the tongue when the slide lock is in its locking position for positively preventing the tongue from movement to its unlatching position, thereby providing a dead bolt function.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
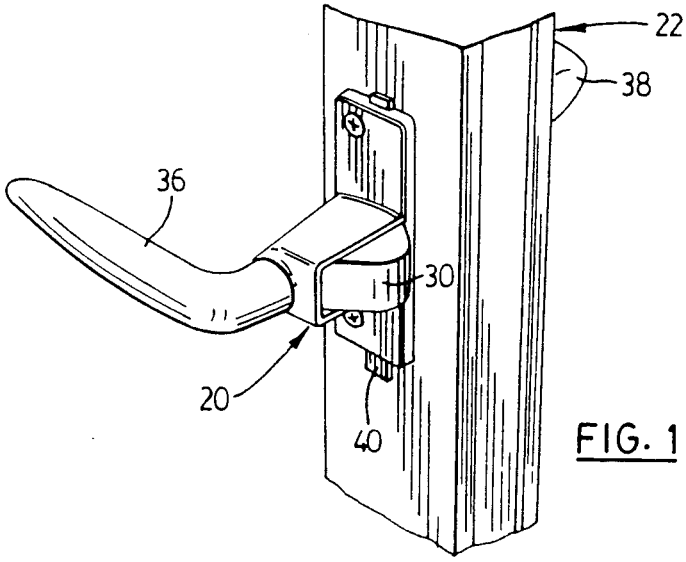
FIG. 1 is a perspective view of a latching mechanism embodying various aspects of the present invention mounted on a storm door.
Figure 3:
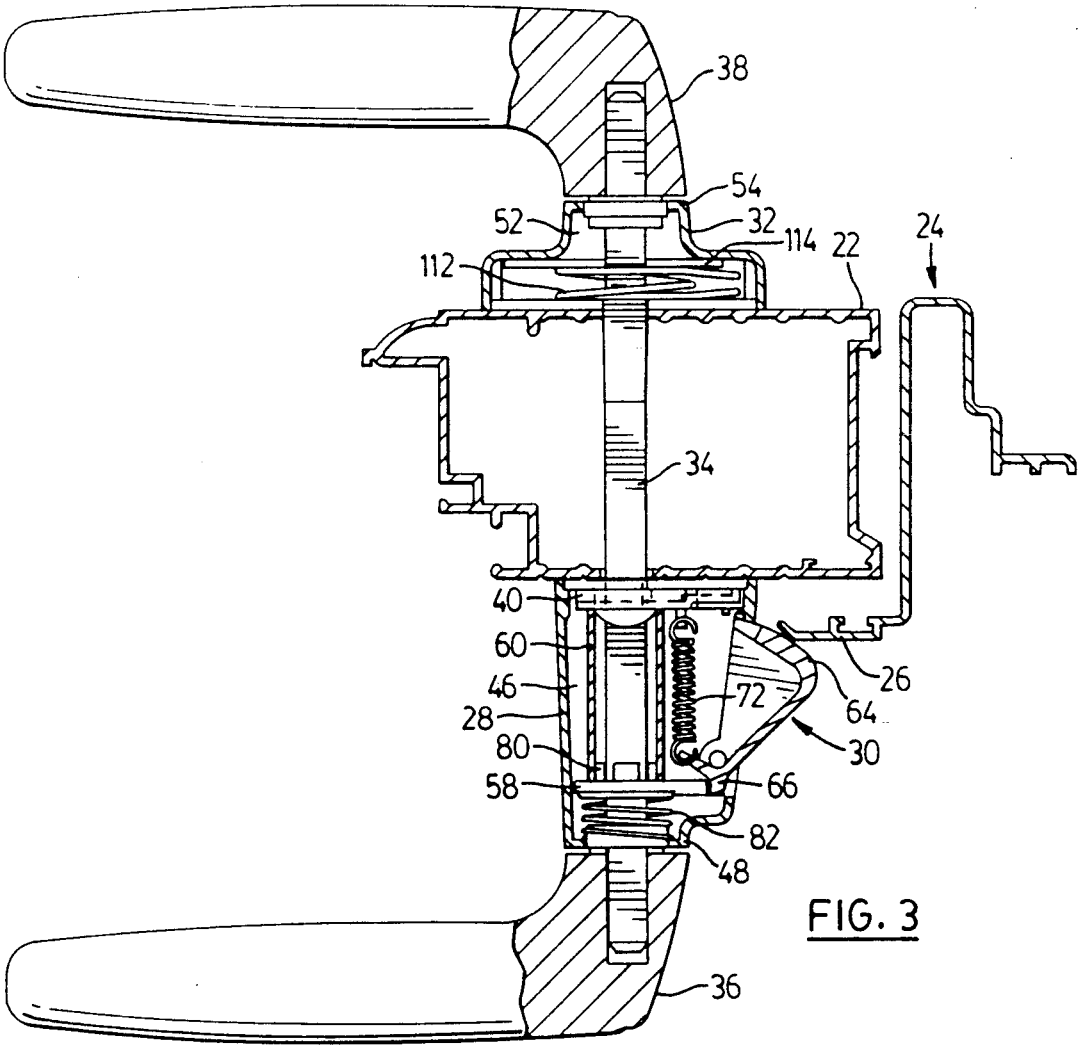
FIG. 3 is a plan view of the mounted latching mechanism with a latch engaging a channel of a door jamb, with the latching mechanism in its unlocked position, and with certain components shown in section.

Referring now to the drawings, a latching mechanism embodying various aspects of the present invention, shown mounted on the frame of a closure such as a storm door 22, is generally indicated in FIG. 1 by reference numeral 20. As best shown in FIG. 3, the doorway frame includes a mounting channel 24 having a striker plate 26 extending into the doorway. The latching mechanism 20 includes an inside housing 28 pivotally holding a latch 30 having a latching or extended position in which the striker plate is located between the door frame and the latch to interfere with opening of the door. The latch also has an unlatching or retracted position in which the latch is disposed not aligned with the striker plate and substantially inside the housing 28 to permit opening of the door. The latching mechanism also comprises an outside housing 32, an operating shaft 34 extending through the door frame and both housings, an inside operator or handle 36 carried by the shaft, and an outside operator or handle 38 also carried by the shaft. The shaft 34 has a non-circular and preferably square cross section. The mechanism 20 additionally includes locking means including a lock slide 40, best shown in FIG. 9, the actuation of which disassociates the latch from the operation of the handles and which positively blocks the latch from moving to its unlatching position.

Figure 2:
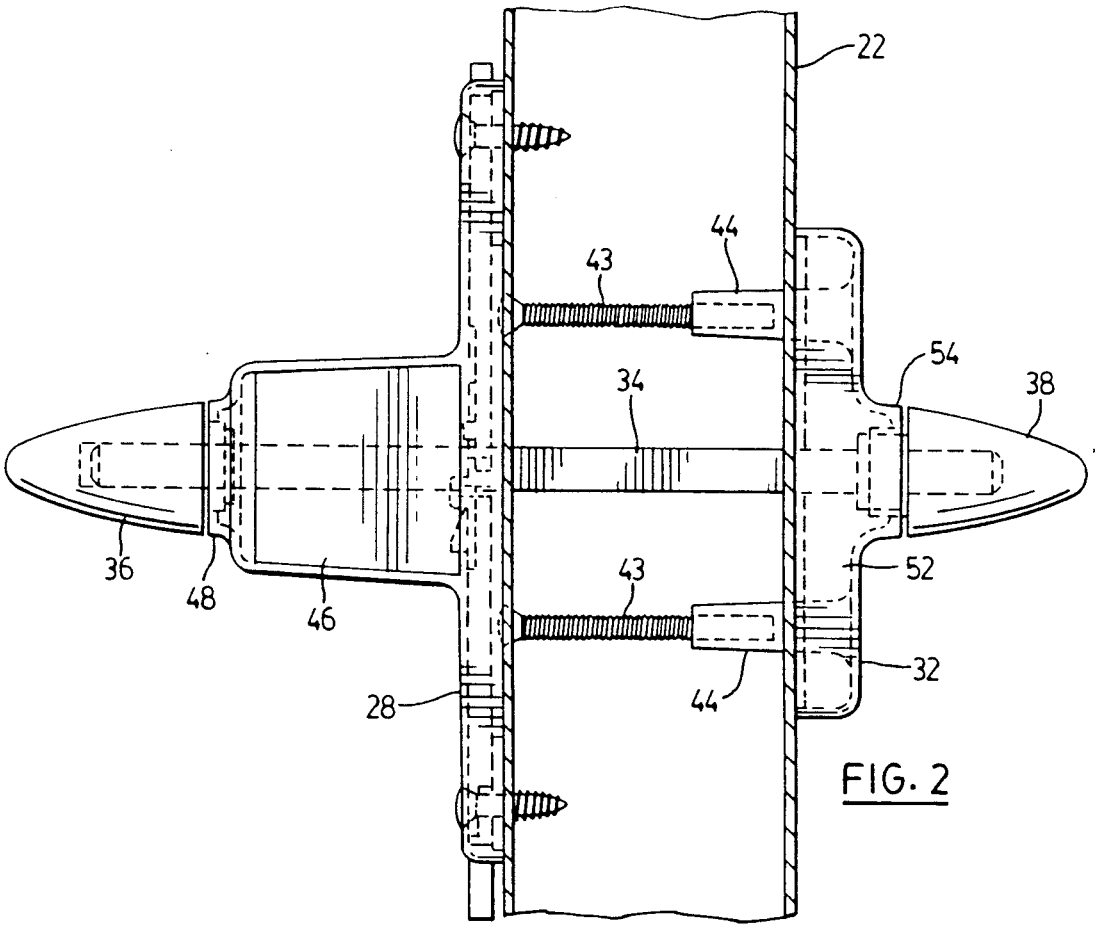
FIG 2 is a side elevational view of the mounted latching mechanism with certain components shown in phantom.
Figure 5:
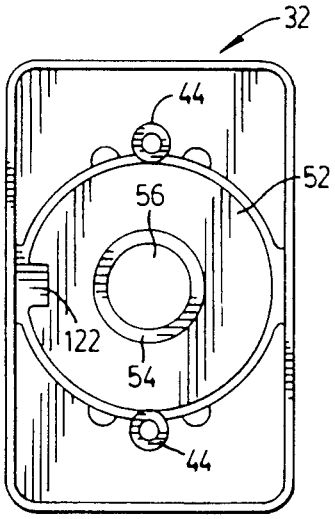
FIG. 5 is a rear elevational view of an outside housing for the latching mechanism of FIG. 1.
Figure 5A:
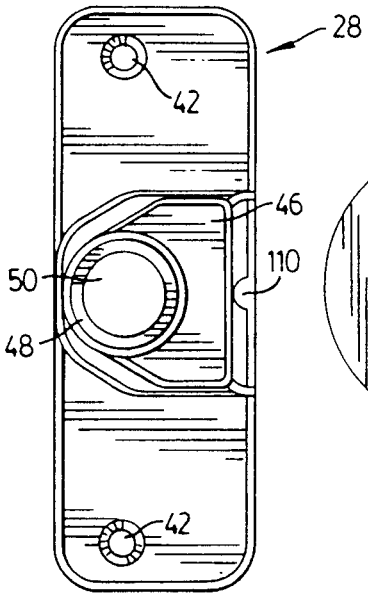
FIG. 5A is a front elevational view of an inside housing for the latching mechanism of FIG. 1

More specifically, the inside housing 28 can be attached to the storm door, as shown in FIG. 2, by screws. The inside housing also includes apertures 42, as shown in FIG. 5A, for passage of relatively long screws 43 received in internally threaded posts 44 in the outside housing 32, best shown in FIG. 5, for holding the outside housing in position against the outside surface of the storm door. The inside housing 28 defines a cavity 46 for receiving various components of the locking means and has an end wall 48 defining an opening 50 receiving a bushing for rotatably supporting the operating shaft as it passes from the housing. Similarly, the outside housing includes a cavity 52 for receiving components for biasing the operating shaft so that the handles are in their horizontal positions shown, and limiting the extent of pivotal movement of the handles, as will be discussed more fully hereinafter. Also the outside housing has an end wall 54 defining an opening 56 receiving a bushing for rotatably supporting the shaft as it passes from the outside housing.

Figure 7:
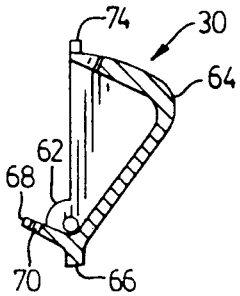
FIG. 7 is a horizontal cross-sectional view of the latch.
Figure 8:
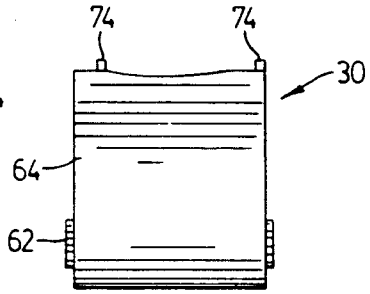
FIG. 8 is a side elevational view of the latch.

As shown in FIG. 3, the components of the locking means located in the inner housing cavity 46 include parts of the latch 30 (best shown in FIGS. 7 and 8), cam means in the form of a cam plate 58 (best shown in FIG. 11) which is rotatable with the shaft 34 and axially slidable with respect to the shaft, and a cylindrical sleeve 60 disposed about the shaft 34 between the cam plate 58 and the lock slide 40. Referring to FIGS. 7 and 8, the latch 30 includes a hub 62 having a bore receiving a pin extending between upper and lower walls of the inside housing 28 to pivotally mount the latch on the inside housing. The latch also includes a tongue 64 having a proximal end connected to the hub and a distal end for engaging the striker plate 26. A drive finger 66, for engagement by the cam plate 58, extends from the hub away from the tongue. The latch also has a spring support finger 68 including a bore 70 for receiving one end of a biasing spring 72, the other end of which is held by the lock slide 40, for biasing the latch to its latching position. Furthermore, the latch includes a pair of spaced noses 74 at the distal end of the tongue 64 for cooperating with components of the lock slide to provide the dead bolt function.

Figure 4:
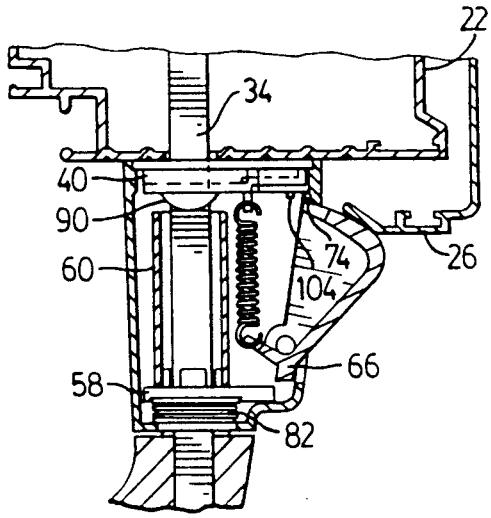
FIG. 4, similar to FIG. 3, shows the latching mechanism in its locking position.
Figure 11:
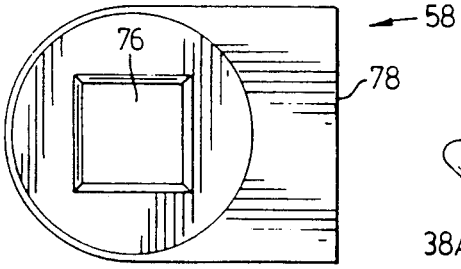
FIG. 11 is an enlarged front elevational view a cam plate for pivoting the latch and which is carried on the shaft interconnecting the inside and outside door handles.
Figure 12:
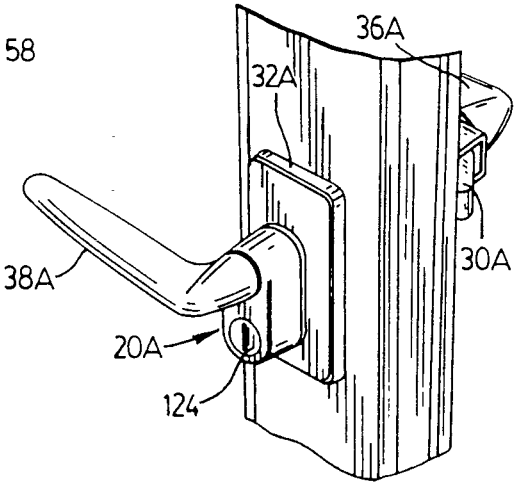
FIG. 12 is a perspective view of an alternative embodiment of the latching mechanism of the present invention including a key lock subassembly.

The cam plate 58 is slidable with respect to the operating shaft between an operative position as shown in FIG. 3 wherein the plate is aligned with the drive finger 66 of the latch 30, and an inoperative position as shown in FIG. 4 in which the cam is not in alignment with the drive finger. As shown in FIG. 11, the cam plate 58 has a square window 76 for passage of the square cross section operating shaft 34 with the window being slightly larger than the shaft so that the cam plate rotates with the shaft and can axially slide on the shaft. The plate 58 also has a flat cam surface 78 which extends vertically when the shaft is in its biased position (the handles 36 and 38 extend horizontally as in FIG. 1). Thus with the cam plate in its operative position, rotation of one of the handles causes the cam surface to bear upon the drive finger 66 resulting in the latch pivoting to its unlatching position so that the door can be opened. As shown in FIG. 3, the cam plate has a locating ring 80 extending from its inside surface and sized for reception in the sleeve 60 to positively locate the sleeve. A coiled extension spring 82, disposed about the shaft between the end wall 48 of the inside housing and cam plate, biases the cam plate to its operative position.

Figure 9:
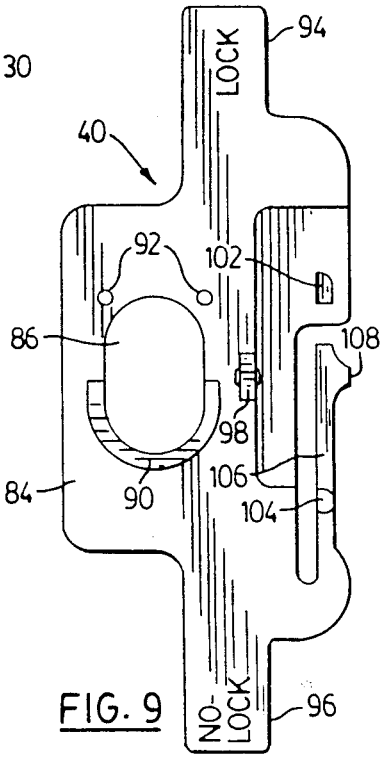
FIG. 9 is a front elevational view of a lock slide of the latching mechanism.
Figure 10:
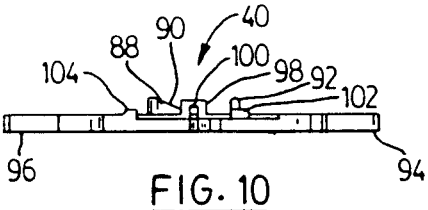
FIG. 10 is a side elevational view of the lock slide of FIG. 9.

Referring to FIGS. 9 and 10, the lock slide 40 includes a main body 84 defining a vertically elongated window 86 for passage of the operating shaft 34. An arcuate ramp 88 bounds the lower portion of the window and has a ramp surface 90 for engaging the sleeve 60 to control movement of the cam plate 58 to its inoperative position. The cam surface slopes outwardly and downwardly. Positioned adjacent to top of the window 86 are a pair of spaced protuberances 92 for engaging the top of the sleeve to maintain the sleeve on the cam surface even when the slide has been moved to its lower or unlocking position shown in FIG. 1. Extending from the main body 84 is an upper leg 94 for extending through a recess in the top wall of the inside housing, bearing indicia that the mechanism is locked, and a lower leg 96 for extending through a recess in the bottom wall of the inside housing and bearing indicia that the mechanism is unlocked. These recesses are sized to guide movement of the lock slide between its locking position in which the ramp moves the cam plate against the bias of the spring 82 to its inoperative position, and the unlocking position of the lock slide wherein the spring 82 is permitted to move the cam plate into alignment with the drive finger of the latch. The lock slide has an anchor 98 defining an opening 100 for receiving the other end of the latch bias spring 72.

Figure 15:
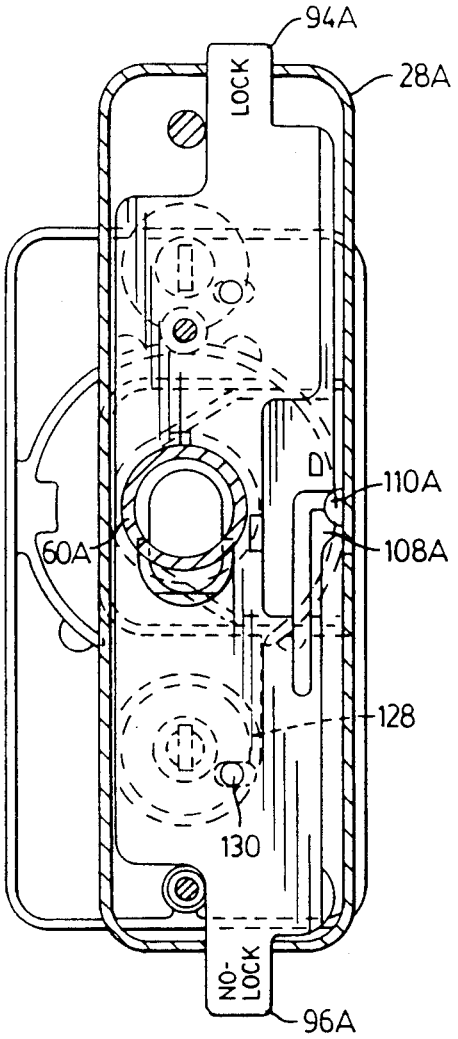
FIG. 15 is a simplified front elevational view of the alternative latching mechanism, with certain components removed to expose other components, illustrating the mechanism in its unlocked condition.
Figure 16:
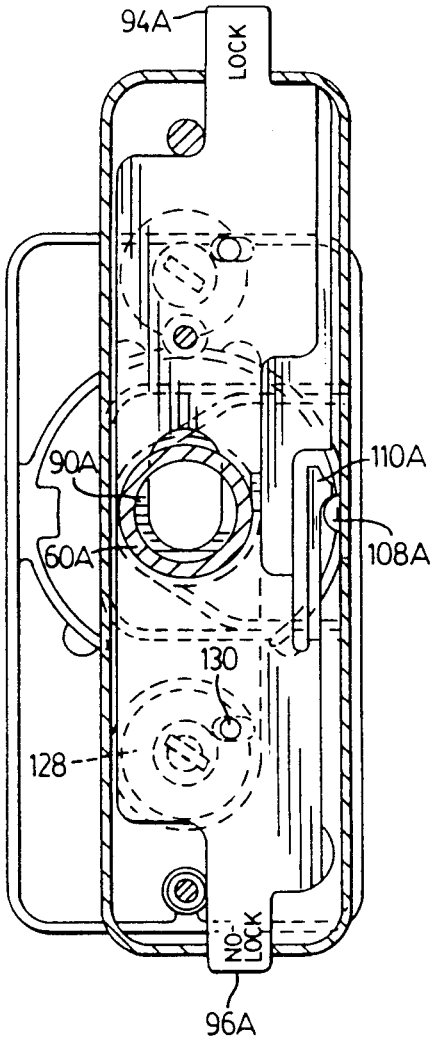
FIG. 16, similar to FIG. 15, shows the alternative latching mechanism in its locked condition.

Upper and lower abutments 102 and 104, respectively, are located on the main body 84 and have the same spacing as the latch tongue noses 74. When the slide is in its locking position, the abutments 102 and 104 are aligned with their corresponding latch tongue noses to positively prevent the tongue from moving to its unlatching position. The lower abutment 104 is located on a deflectable spring arm 106 the lower end of which is joined to the main body. The free or upper end of the arm 106 has a positioning extension 108 for cooperation with a lock slide positioning detent 110 carried by the inside housing adjacent cavity 46, as shown in FIG. 5A. The detent has an arcuate working surface and the positioning extension has upper and lower guide surfaces with the result that the combination provides the operator with a tactile indication of the position of the lock slide, and furthermore serves to maintain the slide in the position to which it has been moved by the user, as best shown in FIGS. 15 and 16.

Figure 6:
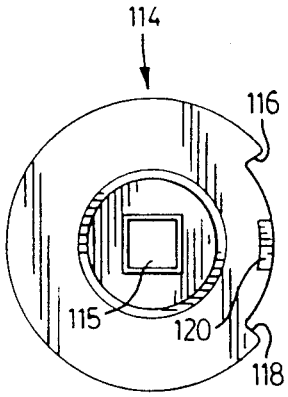
FIG. 6 is a front elevational view of a spring engagement disk for cooperating with a torque spring retained in the outside housing to bias the handles of the latching mechanism to a predetermined position.

Referring again to FIG. 3, located in the cavity 52 of the outer housing 32 are a torque spring 112 encircling the operating shaft 34, and a spring support 114 mounted on the shaft for rotation therewith. As shown in FIG. 6, the disk-shaped spring support includes a square cross section bore 115 for receiving the shaft 34. About a 90 degree sector is removed from the periphery of the support, with the sector being bounded by an upper abutment surface 116 and a lower abutment surface 118. A spring engagement post 120 is positioned adjacent the sector midway between the abutment surfaces. Referring the FIG. 5, the outside housing has a rotation-limiting tooth 122 for extending into the sector of the spring support. In the biased position of the shaft in which the handles are horizontal, the upper leg of spring 112 concurrently engages the upper surfaces of the post 120 and the tooth 122 while the lower leg of the spring simultaneously engages the lower surfaces of the post and tooth. The handles 36 and 38 can always be rotated about 40 degrees in either the clockwise or counterclockwise direction, which rotation is limited by one of the abutment surfaces 116 or 118 contacting the tooth 122. Of course such rotation spreads the legs of the torque spring 112 which is loaded even in the quiescent state of the shaft 34. Thus upon release of the handles by the operator, the torque spring returns the shaft to it's biased position in which the cam surface 78 is vertically disposed and the latch 30 moves to its latching position under the influence of the spring 72.

Operation of the latching mechanism of the subject invention is as follows. With the lock slide 40 in its unlocking position with the lower arm 96 extending beyond the bottom of the inside housing and with the "NO-LOCK" indication visible, a handle 36 or 38 may be pivoted causing movement of the latch 30 to its unlatching position. Upon rotation of the handles, the cam plate 58 bears on the drive finger 66 of the latch 30 causing the latch tongue 64 to pivot inwardly thereby allowing the door to be opened. Upon release of the handles, the torque spring 112 returns the shaft 34 to its rest position with the handles extending horizontally. Upon upward movement of the lock slide 40 to its locking position with the upper arm 94 extending above the inside housing and the indication "LOCK" visible, the operation of the handles becomes disassociated from movement of the latch. This results because the ramp 88 pushes the sleeve 60 outwardly which in turn pushes the cam plate 58 to an outward position wherein it is no longer aligned with the drive finger 66. Additionally, the abutments 102 and 104 become aligned with the noses 74 of the tongue 64 to positively prevent movement of the latch 30 to its unlatching position. Thus movement of the lock slide 40 to its locking position not only disconnects the handles from movement of the latch, but also performs the dead bolt function.

An alternative embodiment of the present invention is shown in FIGS. 12–16, in which the alternative embodiment of the latching mechanism is indicated by reference character 20A. Components of latching mechanism 20A corresponding to those of latching mechanism 20 are indicated by the number assigned to the component of latching mechanism 20 with the addition of the suffix "A". The main difference between the two embodiments is that the alternative embodiment has a key lock feature so that by insertion and turning of an appropriate key in the outside housing 32A, the lock slide 40A can be moved to its "NO-LOCK" position thereby permitting operation of the outer handle 38A to cause the latch 30A to move to its unlatching position.

Figure 13:
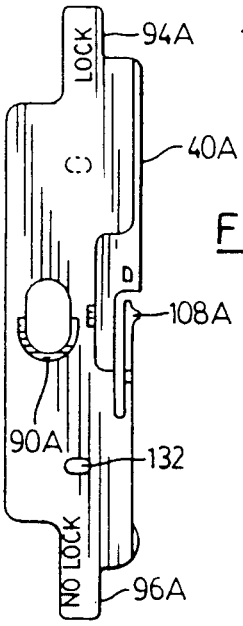
FIG. 13 is a front elevational view, similar to FIG. 9, of a lock slide of the alternative embodiment.
Figure 14:
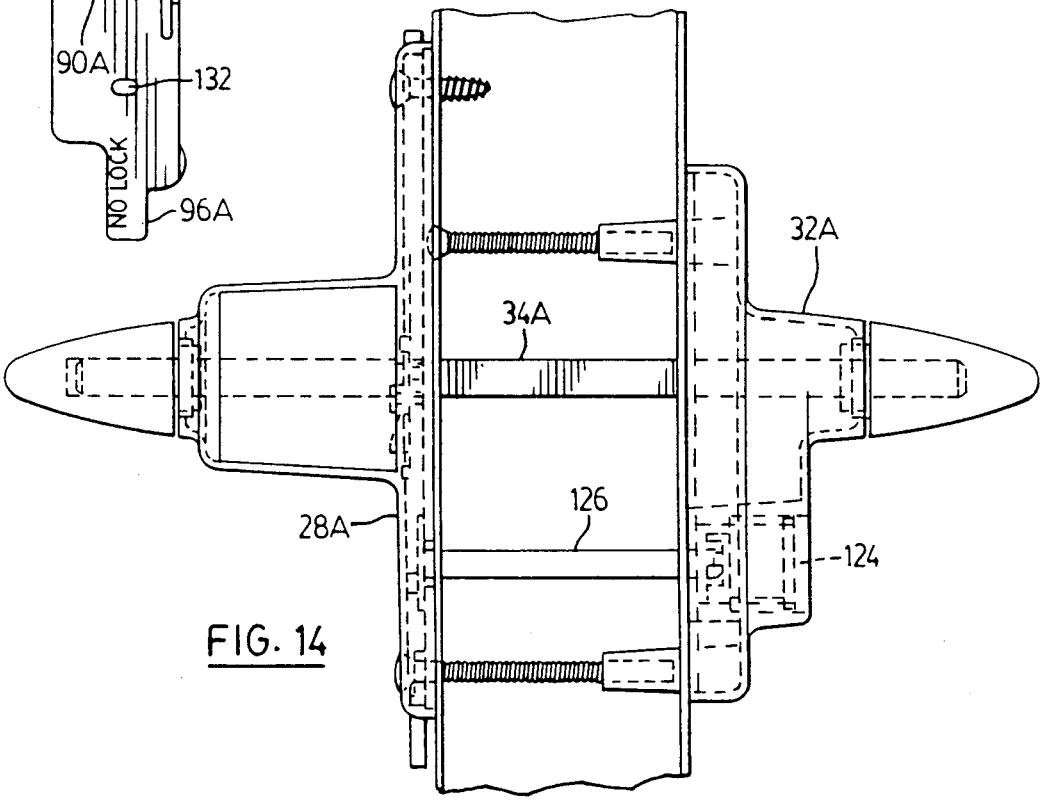
FIG. 14, similar to FIG. 2, illustrates the latching mechanism of the alternative embodiment.

Referring to FIG. 14, the outside housing 32A now houses a key cylinder 124. Details of the cylinder need not be discussed herein. It is sufficient to note that insertion of a proper key into the cylinder permits its rotation wherein insertion of an improper key does not permit the cylinder to rotate. Extending from the cylinder 124 through the storm door and into the inside housing 28A is a spindle 126 with the free end of the spindle carrying a disc 128 having a pin 130 which is eccentric with respect to the spindle. Referring to FIG. 13, the lock slide 40A is provided with a horizontally elongated slot 132 which receives the pin. As shown in FIGS. 15 and 16, rotation of the cylinder causes the pin to move the lock slide 40A between its unlocking position shown in FIG. 15 and its unlocking position shown in FIG. 16.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A latching mechanism for mounting on a closure, such as a storm door, for holding the closure in an opening, such as a doorway, said opening being defined by a frame including a striker, said latching mechanism comprising:

an inside housing for mounting on the inside of said closure;

a latch movably mounted on said inside housing, said latch including a tongue movable between a latching position in which said tongue will engage said striker upon attempted opening of said closure and an unlatching position wherein said tongue is not aligned to engage said striker, said tongue being biased toward said latching position;

an operating shaft extending through said closure and said inside housing, and pivotally mounted with respect to said closure and said housing;

an inside operator mounted on said shaft inside said closure;

an outside operator mounted on said shaft outside said closure;

cam means rotatable with said shaft and axially slidably with respect to said shaft between an operative position wherein said cam means is located to move said tongue toward said unlatching position upon actuation of one of said operators and an inoperative position wherein rotation of said cam means does not cause said tongue to move to said unlatching position; and locking means for movement by a user between a locking position in which said-locking means causes said cam means to be moved to said inoperative position, and an unlocking position in which said cam means is permitted to be in said operative position, said locking means including abutment means for positioning in alignment with said tongue when said locking means is in its locking position for positively preventing said tongue from movement to said unlatching position.

2. A latching mechanism as set forth in claim 1 wherein said latch includes a hub defining a circular bore for receiving a pin for pivotally mounting said latch on said inside housing, said tongue having a proximal end connected to said hub and a distal end for engaging said striker.

3. A latching mechanism as set forth in claim 2 wherein said latch further includes a drive finger extending from said hub away from said tongue, said cam means being mounted on said shaft and including a cam surface for engaging said drive finger when said shaft is rotated and said cam means is in its operative position.

4. A latching mechanism as set forth in claim 3 further comprising shaft biasing means for biasing said shaft so that when in its operative condition said cam means does not move said tongue toward its unlatching position unless one of said operators is rotated.

5. A latching mechanism as set forth in claim 3 wherein said shaft has a non-circular cross section and wherein said cam means has a corresponding non-circular aperture through which said shaft extends.

6. A latching mechanism as set forth in claim 4 further comprising an outer housing, said shaft extending through said outer housing, each of said housings supporting said shaft for rotation.

7. A latching mechanism as set forth in claim 6 further comprising a spring support rotatable with said shaft and disposed in said outer housing, said shaft biasing means comprising a torque spring encircling said shaft and having ends bearing on said spring support and on a component of said outer housing.

8. A latching mechanism as set forth in claim 2 wherein said latch further comprises a spring support finger extending from said hub, said mechanism including a biasing spring interconnecting said spring support finger and said locking means for biasing said tongue to said latching position.

9. A latching mechanism as set forth in claim 1 wherein said locking means comprises a slide including a main body defining a window for passage of said shaft, said body having a ramp disposed adjacent said window for controlling movement of said cam means.

10. A latching mechanism as set forth in claim 9 wherein said body is disposed in said inside housing, said inside housing having an upper recess and a lower recess, said slide having an upper leg for extension through said upper recess and a lower leg for extension through said lower recess, said inside housing guiding movement of said slide.

11. A latching mechanism as set forth in claim 10 wherein each of said legs bears indicia indicating to the user the position of said locking means.

12. A latching mechanism as set forth in claim 10 wherein said locking means further comprises a sleeve disposed about said shaft between said cam means and said slide body, and an extension spring means bearing against said inside housing and said cam means for biasing said cam means to said operative position.

13. A latching mechanism as set forth in claim 9 wherein said tongue includes a distal end having a pair of spaced noses, said abutment means including a pair of spaced protuberances on said body which are aligned with said noses when said locking means is in its locking position.

14. A latching mechanism as set forth in claim 10 wherein said inside housing includes a slide-positioning detent and wherein said body includes a deflectable resilient spring arm having a free end carrying a positioning extension for engaging said detent to provide the operator with tactile indication of the positioning of said slide and to maintain said slide in a position to which said slide has been moved by the user.

15. A latching mechanism as set forth in claim 9 further comprising an outside housing for mounting on the outside of said closure, said outside housing pivotally holding a key lock cylinder; a spindle having one end connected to said cylinder and extending through said closure; and a disk connected to the other end of said spindle and disposed in said inside housing, said disk having an eccentric drive pin, said slide body having an elongated horizontal slot receiving said pin so that selective operation of said key lock cylinder causes movement of said locking means between its locking and unlocking positions.

16. A latching mechanism for mounting on a storm door for holding the door in a doorway, said doorway being defined by a frame including a striker, said latching mechanism comprising:

an inside housing for mounting on the inside of said door;

an outside housing for mounting on the outside of said door;

a latch pivotally mounted on said inside housing, said latch including a tongue movable between a latching position in which said tongue will engage said striker upon attempted opening of said door and an unlatching position wherein said tongue is not aligned to engage said striker, said tongue being biased to said latching position;

an operating shaft extending through said housings and said door and pivotally mounted on said housings;

inside and outside handles mounted on the respective ends of said shaft;

a cam disposed in said inside housing, rotatable with said shaft, and axially slidable with respect to said shaft between an operative position wherein said cam is located to move said tongue toward said unlatching position upon rotation of said handles and an inoperative position wherein rotation of said cam does not cause movement of said tongue; and a slide lock guided by said inside housing for linear movement, said lock having a window through which said shaft passes, said lock having a ramp surface disposed adjacent said window for controlling axial movement of said cam, said slide lock being movable by a user between a locking position in which said slide lock causes said cam to be moved to said inoperative position and an unlocking position in which said cam is permitted to be is said operative position.

* * * * *